US011452357B2

(12) United States Patent
Ripoli

(10) Patent No.: US 11,452,357 B2
(45) Date of Patent: Sep. 27, 2022

(54) APPLICATOR FOR PASTY COSMETIC PRODUCTS

(71) Applicants: Luis Christian Antonini, La Fontaine Saint-Martin (FR); Pablo Eugenio Ripoli, Escobar (AR)

(72) Inventor: Pablo Eugenio Ripoli, Escobar (AR)

( * ) Notice: Subject to any disclaimer, the term of this patent is extended or adjusted under 35 U.S.C. 154(b) by 465 days.

(21) Appl. No.: 16/610,477

(22) PCT Filed: Apr. 27, 2018

(86) PCT No.: PCT/EP2018/060945

§ 371 (c)(1),
(2) Date: Nov. 1, 2019

(87) PCT Pub. No.: WO2018/202591

PCT Pub. Date: Nov. 8, 2018

(65) Prior Publication Data

US 2021/0153627 A1 May 27, 2021

(30) Foreign Application Priority Data

May 3, 2017 (AR) ..... P20170101140

(51) Int. Cl.

| | |
|---|---|
| ***A45D 40/00*** | (2006.01) |
| ***B65D 75/58*** | (2006.01) |
| ***B65B 9/02*** | (2006.01) |

(52) U.S. Cl.

CPC .. *A45D 40/0087* (2013.01); *A45D 2200/1027* (2013.01); *A45D 2200/1036* (2013.01); *B65B 9/023* (2013.01); *B65D 75/5855* (2013.01)

(58) Field of Classification Search

CPC ..... A45D 40/0087; A45D 37/00; A45D 2200/1027; A45D 2200/1045; B65D 75/5855; B65D 75/30; B65D 75/58; B65D 75/50; B65B 7/02; B65B 9/00; B65B 9/02; B65B 9/023; B65B 9/026; B65B 9/042; B65B 9/045

USPC ..... 401/132–135

See application file for complete search history.

(56) References Cited

U.S. PATENT DOCUMENTS

| | | | | |
|---|---|---|---|---|
| 4,372,098 A | | 2/1983 | Mason | |
| 4,747,782 A | | 5/1988 | Campbell, Jr. | |
| 5,368,581 A | * | 11/1994 | Smith | A61Q 17/04 604/289 |
| 6,006,916 A | * | 12/1999 | Matsos | A45D 40/0087 206/229 |
| 10,815,042 B2 | * | 10/2020 | Cardin | B65B 61/06 |

FOREIGN PATENT DOCUMENTS

| | | |
|---|---|---|
| EP | 1091666 B1 | 2/2004 |
| EP | 2594154 A1 | 5/2013 |

* cited by examiner

*Primary Examiner* — David J Walczak
(74) *Attorney, Agent, or Firm* — Lombard & Geliebter LLP; Eric J. Huang

(57) ABSTRACT

An applicator for pasty cosmetic products that allows a better handling of the applicator in order to significantly improve the distribution of the cosmetic product during its application, and in turn, avoids "getting dirty" and/or "stained" with the cosmetic product or contaminating the same during its handling, thanks to the fact that it has separate sectors each with different purposes and a removable laminar cover that covers the entire applicator.

11 Claims, 3 Drawing Sheets

APPLICATOR FOR PASTY COSMETIC PRODUCTS

CROSS-REFERENCE TO RELATED APPLICATIONS

This application is a national phase of International Application No. PCT/EP2018/060945, filed on Apr. 27, 2018, which claims priority to Argentina Application No. P20170101140, filed on May 3, 2017, the entire contents of each of which are incorporated herein by reference.

BACKGROUND OF THE INVENTION

Field of the Invention

The present invention relates to the field of accessories, means or arrangements used in the personal care industry, more specifically to sample cosmetics, and more particularly to an applicator for pasty cosmetic products, such as a deodorant or antiperspirant, which, unlike conventional applicators, allows a better handling of the applicator to significantly improve the distribution of the cosmetic product during its application, and in turn, avoids "getting dirty" and/or "stained" with the cosmetic product or contaminating the same during handling.

Even though the present disclosure refers to an applicator for pasty cosmetic products such as antiperspirants, deodorants and/or fragrances, it should be understood that the applicator of the present invention can be used to contain and dispense various pasty and/or flowable products used in other fields.

Background Art

Samples of cosmetic products are well known in many stores and cosmetics businesses where customers usually try these products before buying them. In this way, you can try lipsticks, of different colors, personal care creams and powders to color the skin. To this end, for example, a skin powder can be presented as a small sample on a paper support, covered by a removable cover that when removed leaves the powder sample accessible so that the user can extract it with the yolk of one of her fingers and spread it on the skin to see the effect as applied.

There are other container devices for cosmetic samples that are basically comprised of the same components as the devices mentioned above but are designed to directly apply, with the device, the sample product on the body part where it is desired to be tested. These sample carriers, unlike those mentioned above, can be identified as sample applicators.

These sample applicators are well known and, in addition to being able to be employed in cosmetics stores and businesses, to test different products, they are also useful as courtesy or gift products in hotels, sports institutions, gyms, etc. Among the sample applicators of this type, there is known a lipstick applicator device disclosed in U.S. Pat. No. 4,747,782 comprising two sheets folded and adhered on themselves and provided with parallel sectors separated by breakable punched lines. Between the folded sheets are disposed, in said sectors, accessible lipstick samples once a sheet of sample coating has been removed, in the selected sector, exposing the sample of lipstick placed on the other of the sheets initially adhered. The product samples are contained only between the folded sheets, on interleaved sectors while the rest of the sectors, interspersed between such sectors with samples, are only intended to be taken by the user's hand to place the sample against her lips and so deposit it in her lips. Therefore, the cover sheet, protecting the sample, only extends over the sample.

EP 109166 B1 discloses a personal deodorant applicator that can be considered a sample or a personal dose that can be used in cosmetics stores for testing as well as a gift, in sports institutions, gyms, and similar places. The applicator comprises a substrate of impervious material having an end with a grip area to be taken by the fingers of a user, and an opposite end having a sector provided with cavities inside which a liquid deodorant or antiperspirant is housed. The cavity sector with liquid deodorant is covered by a cover sheet which is peelable and impervious and is perimetrally sealed on the bottom substrate and has a pull ear. To use the device, the user takes the same from the grip area, with one hand, and with the other hand pulls the ear to remove the cover sheet. Once exposed, the deodorant can be applied to the armpit/s. The substrate or sheet containing the deodorant is an EVA/polyethylene foam, which fails to meet the requirements of waterproofing and insulation of the deodorant product, that must be kept intact for months. In addition, if the product is liquid, said substrate can not be tilted or turned over once the cover sheet has been removed because the deodorant product would be spilled. Finally, the fixing of the cover sheet must be done by some type of adhesive, which is generally not suitable for the skin, because the thermal welding of the sheet material is usually not effective between the material of the cover sheet and the foam of the substrate. In addition, the grip area is permanently uncovered and exposed to the continuous action of people who only manipulate the applicator out of curiosity without using it. Whoever finally uses will find an applicator, though sealed in the container portion of the sample, already damaged and dirty by the handling of curious persons.

Another cosmetic product sample applicator is the one disclosed in EP 2594154 A1 consisting of a molded plastic laminate substrate where two areas are defined, a grip area intended to be taken by the user's fingers, and a container portion of a sample of lipstick, intended to be interposed between the lips of the user to apply the lipstick sample on the lips and thus test the product. The area containing the lipstick has a series of channels embedded in the plastic material and a series of peaks formed when embedding said channels, the area being limited by a projecting edge intended to contain the mass of lipstick within the area preventing, as a perimeter barrier, the product spreading beyond the boundaries. This same pattern of grip and lipstick containment areas is repeated on the other side of the substrate, so that when it is interposed between the lips, each lip receives its sample from each side of the substrate. It is explained that the lipstick mass is loaded into the channels under temperature so that said mass flows into the channels leaving the protruding peaks so that the container wherein the device is housed is in contact with said peaks without touching the mass of cosmetic product. Nothing is said about that said lipstick container contains a removable cover sheet.

Therefore there is no cosmetic product sample or dose personal applicator that is entirely covered by a peelable cover sheet having a sealed coating area for the sample and a coating area with free pull edges, allowing an isolated conservation, both of the sample and the grip surfaces, especially when the applicator is handled by several people only out of curiosity whether in stores or sports institutions.

BRIEF DESCRIPTION OF THE INVENTION

Therefore, it is an object of the present invention to provide an applicator for pasty cosmetic products which avoids contamination of the handling portion by third parties.

It is also another object of the present invention to provide an applicator for pasty cosmetic products that safeguards and protects the product in a safe and reliable manner.

It is still another object of the present invention to provide a more hygienic and safer applicator of pasty cosmetic products.

It is still another object of the present invention to provide a removable laminar cover that protects the entire extension of the applicator, so that it can also have a free portion from which it can be removed to access the retained cosmetic product to be applied.

It is another object of the present invention to provide an applicator for pasty cosmetic products comprising a laminar substrate of polyolefin foam having a lower face and an upper face, a polyester film adhered to said upper face of said laminar substrate, wherein said polyester film and said laminar substrate have a sealing closed perimeter enclosing a container portion, a removable laminar cover extended over the entire extension of said polyester film and said laminar substrate, and adhered to said polyester film and said laminar substrate at said sealing closed perimeter, a first roughness formed inside said container portion, and comprising a deformation of said polyester film and said upper face of the laminar substrate, and said pasty cosmetic product is retained in said first roughness inside the container portion, a second roughness formed by at least one handling portion outwardly of said sealing closed perimeter, and comprising a deformation of said polyester film and said upper face of the laminar substrate, wherein said handling portion is covered by a portion free from said removable laminar cover, and said free portion has at least an edge adhered to said sealing closed perimeter and at least a free edge not adhered to said polyester film and said upper face of the laminar substrate.

BRIEF DESCRIPTION OF THE DRAWINGS

For greater clarity and understanding of the object of the present invention, it has been illustrated in several figures, where the invention has been represented in one of the preferred embodiments, all by way of illustration, wherein.

DETAILED DESCRIPTION OF THE INVENTION

Figure 1:
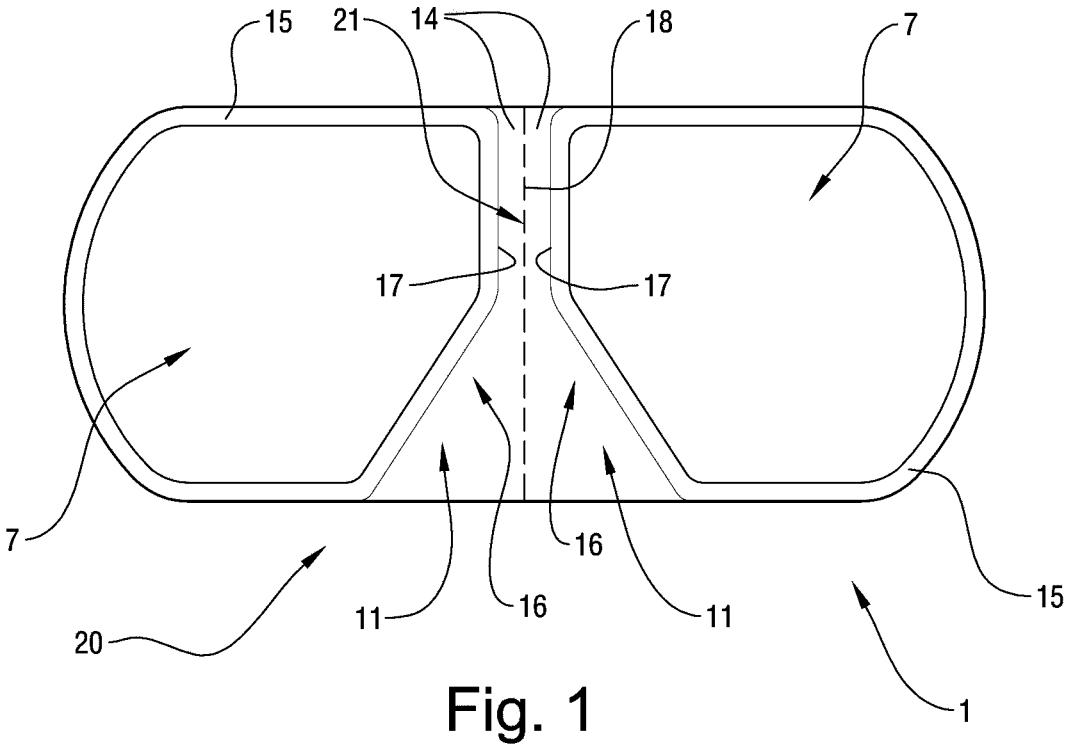
FIG. 1 shows a top view of the applicator of pasty cosmetic products according to the present invention, wherein the arrangement of two contiguous applicators attached in a punched manner can be seen.

Referring now to the figures, it can be seen that the invention relates to a new applicator for pasty cosmetic products that allows a better handling of the applicator to significantly improve the distribution of the cosmetic product during its application, and in turn, avoids "getting dirty" and/or "stained" with the cosmetic product or contaminating the same during handling.

Thus, and according to FIGS. 1 to 5, the applicator of the present invention is indicated by the general reference 1 and comprises at least one laminar substrate of polyolefin foam 2 having a lower face 3 and an upper face 4 on which a film is adhered 5, wherein, said film 5 adhered to the substrate 2 and said laminar substrate 2 have a sealing closed perimeter 6 enclosing a container portion 7. Said film 5 is selected from polyester, aluminized polyester, polypropylene, PVDC, polyamide and combinations thereof. Said laminar substrate of polyolefin foam has a thickness of between preferably 0.5 mm and 4.0 mm and more preferably a thickness of 1.5 mm, while said polyester film has a thickness preferably between 8 and 50 microns, and more preferably a thickness of 12 microns.

The present invention has a first roughness 8 formed inside said container portion 7, that comprises a deformation of said polyester film 5, wherein at said first roughness 8 a pasty cosmetic product 9 is retained which can be selected from the group consisting of deodorants, antiperspirants, fragrances, any cosmetic and medicinal product in any of the following pharmaceutical forms: creams, emulsions, pastes, gels, jelly, ointment, etc. The first roughness 8 is to form a mordant or anchor for the cosmetic product, preferably in paste form, and though it is illustrated only inside said container portion 7, for reasons of ease of manufacture, it may project beyond the closed perimeter of the container portion without detrimental consequences for the invention.

Figure 2:
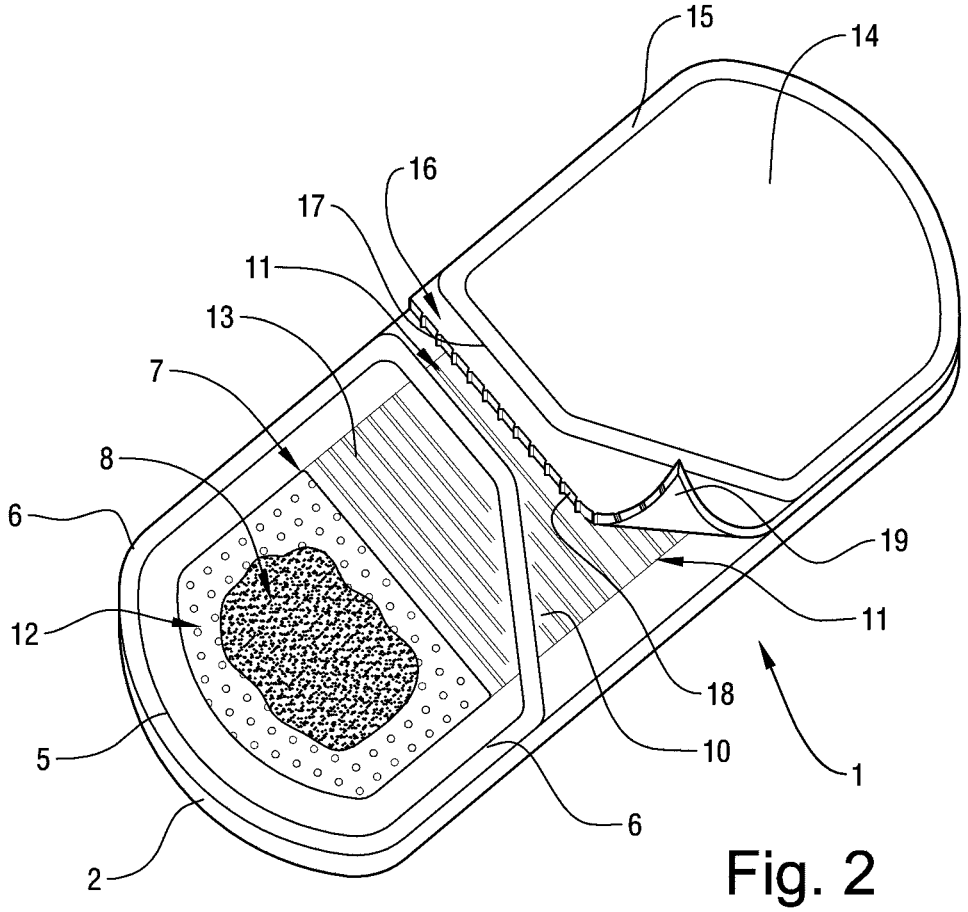
FIG. 2 shows a perspective view of the applicator of the present invention, wherein it can be seen that one of the applicators does not have a removable laminar cover, being able to observe the contents of the applicator and its parts.
Figure 3:
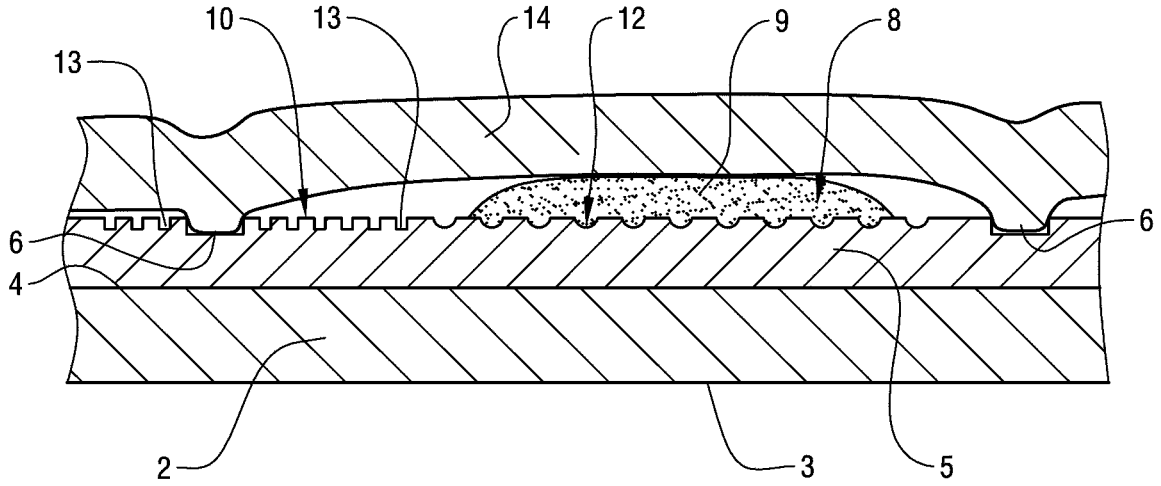
FIG. 3 shows a sectional view of the applicator of the present invention, wherein the disposition and its component parts can be observed.
Figure 4:
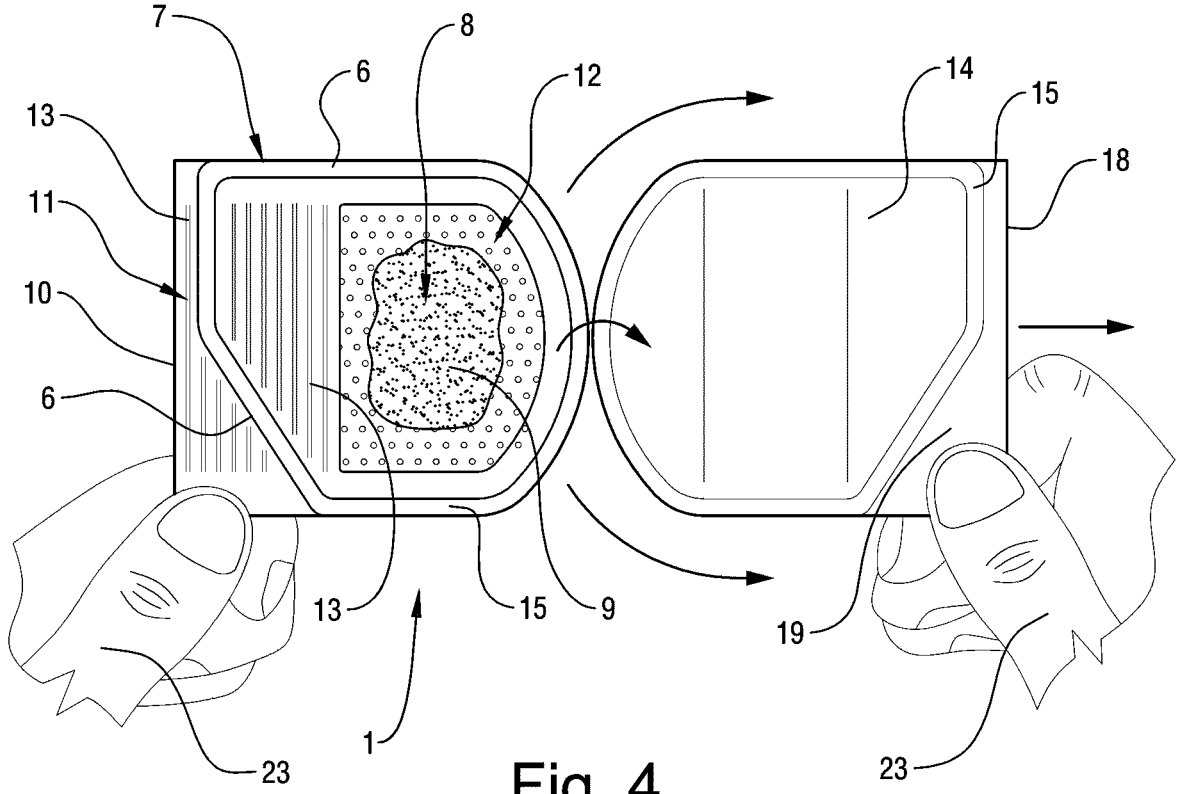
FIG. 4 shows a top view of one of the applicators illustrated in FIGS. 1 and 2, wherein the removable laminar cover can be seen as it is removed to expose the container portion and the cosmetic product.

In turn, it is provided a second roughness 10 formed by at least one handling portion 11 outwardly of said sealing closed perimeter 6, and comprising a deformation of said polyester film 5. Said second roughness 10 can project into the inner portion of sealing closed perimeter 6 and partially inside the container portion 7, coexisting with said first roughness as best illustrated in FIGS. 2 to 4, though this does not limit the scope of the invention.

It should be noted that said first and second roughnesses are embossings, wherein the embossing of the first roughness 8 comprises a plurality of reservoirs 12, and the embossing of the second roughness 10 comprises a plurality of channels 13, without limitation, as other forms of roughnesses can be considered and adapted and used with this invention.

Also, it is provided a removable polyester laminar cover 14 projecting over the entire extension of said polyester film 5 and said laminar substrate 2. The removable laminar cover 14 can be selected from polyester laminates, aluminized polyester, heat sealable polyester, aluminum, polypropylene, PVDC, polyamide, heat sealable lacquer and combinations thereof. The cover 14 is attached to said polyester film 5 and said laminar substrate 2 at said sealing closed perimeter 6. More particularly, said removable laminar cover 14 is thermally welded to said sealing closed perimeter 6, forming a perimeter channel 15 that is demarcated both on the laminar cover 14 and the film 5 and substrate 2.

In this manner, said handling portion 11 is covered by a free portion 16 of said removable laminar cover 14, said free portion 16 has at least one edge 17 adhered to said sealing closed perimeter 6 and at least one free edge 18 not fixed to said polyester film 5 and said upper face 4 of the laminar substrate 2, being defined a pull ear 19 to remove the removable laminar cover 14.

As illustrated in FIGS. 1 and 2, the applicator of pasty cosmetic products of the present invention can comprise, but not limited to, a second applicator 20 bonded in a specular shape by a breakable punched edge 21 to the first applicator 1, matching said breakable punched edge 21 with said free edge 18 of the removable laminar cover 14. Also, a graphic (not illustrated) informative and instructive print of the method of use and/or varied information can be disposed on the lower face 3 of the laminar substrate 2, or on the removable laminar cover 14.

Unlike the applicators and conventional samples of the prior art, the applicator of the present invention comprises said removable laminar cover 14 that covers the entire length of the applicator, preventing curious people from grabbing/holding/touching the handling portion and contaminating the device. In turn, by means of said removable laminar cover extended covering the entire applicator, the pasty cosmetic product inside the first roughness 8 of the container portion 7 is also protected. As a result, both the handling portion and the container portion housing the pasty cosmetic product are protected, keeping the integrity and quality of the same. Also, a more hygienic and safe applicator is obtained, avoiding that the cosmetic product overflows and/or is subjected to modifications in its composition due to weather conditions as it is sealed inside the sealing closed perimeter 6. In addition, the materials used for the laminar substrate, removable laminar cover and polyester film are compatible and waterproof materials that guarantee the waterproofing standards required for any kind of pasty and/or flowable product, as well as, materials compatible with thermal welding processes and that do not present a problem for them.

Figure 5:
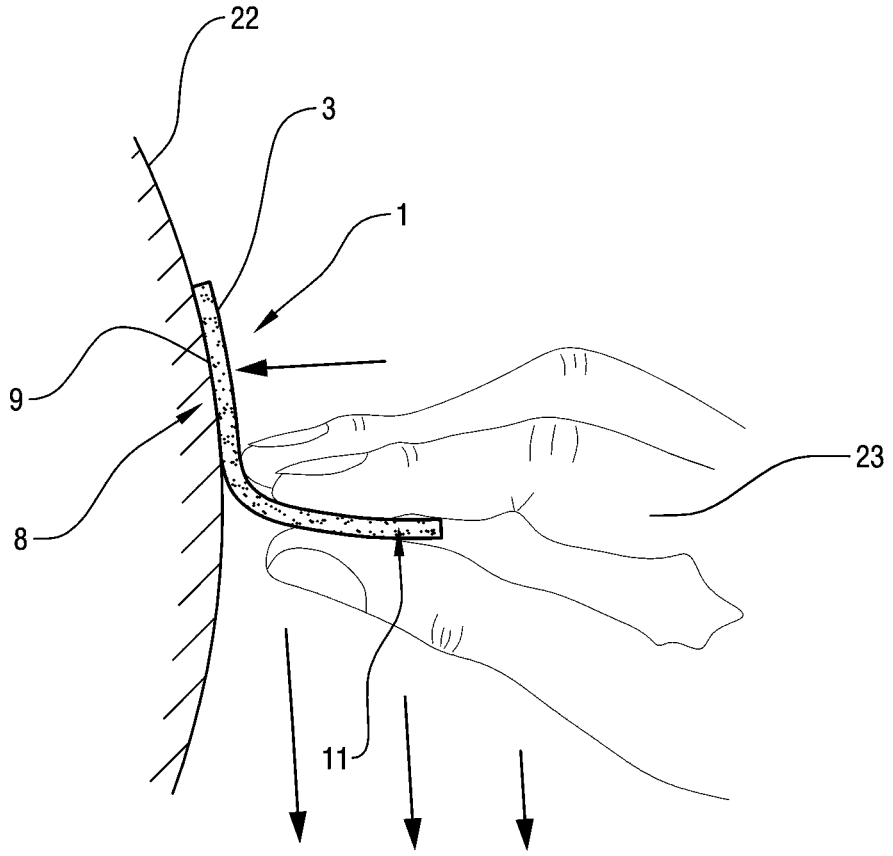
FIG. 5 shows an exemplary view of a possible mode of use, without limitation, of the applicator of the present invention.

The applicator of the present invention can be used to directly apply the cosmetic product on a surface 22 as best illustrated in FIG. 5. In these cases, the person must first separate the applicators 1 and 20 "breaking" the punched edge 21. Then, the person must hold the flange 19 to remove the removable cover 14. Once the cover is removed, the cosmetic product is exposed to the weather. The user can hold with her fingers 23 the applicator partially from the handling portion 11 and partially from the lower face 3 of the laminate substrate 2. Once the applicator is held, the face containing the cosmetic product 9 is disposed facing the surface 22 to apply, and then, exerting a pressure against the surface and "dragging" the applicator downwards, the pasty cosmetic product 9 is applied on it.

Thus it has been described and embodied the applicator for cosmetic products of the present invention.

What is claimed is:

1. An applicator for pasty cosmetic products comprising:

a laminar substrate of polyolefin foam having a lower face and an upper face, a film adhered to said upper face of said laminar substrate, wherein said film has a sealing closed perimeter on top of said film enclosing a container portion, a removable laminar cover extended over an entire extension of said film and adhered to said film at said sealing closed perimeter, a first roughness formed inside said container portion, and comprising a deformation of said film, and said pasty cosmetic product is retained in said first roughness inside the container portion, a second roughness formed by at least one handling portion outwardly of said sealing closed perimeter, and comprising a deformation of said film, wherein said handling portion is covered by a portion free from said removable laminar cover, and said free portion has at least an edge adhered to said sealing closed perimeter and at least a free edge not adhered to said film and, wherein said at least one handling portion located outwardly of the sealing closed perimeter is covered by a pull ear that is part of the at least one free edge, and wherein said second roughness extends inside said sealing closed perimeter, coexisting with said first roughness.

2. The applicator for pasty cosmetic products according to claim 1, wherein said first and second roughnesses are embossings.

3. The applicator for pasty cosmetic products according to claim 2, wherein the embossing of the first roughness comprises a plurality of reservoirs, and the embossing of the second roughness comprises a plurality of channels.

4. The applicator for pasty cosmetic products according to claim 1, wherein said removable laminar cover is thermally welded to said sealing closed perimeter, forming a perimeter channel.

5. The applicator for pasty cosmetic products according to claim 4, wherein said laminar substrate of polyolefin foam has a thickness of between 0.5 mm and 4.0 mm.

6. The applicator for pasty cosmetic products according to claim 1, wherein said film has a thickness of between 8 and 50 microns.

7. The applicator for pasty cosmetic products according to claim 1, further comprising a second applicator bonded in a specular shape by a breakable punched edge.

8. The applicator for pasty cosmetic products according to claim 7, wherein said breakable punched edge is coincident with said free edge of the removable laminar cover.

9. The applicator for pasty cosmetic products according to claim 1, wherein said pasty cosmetic product is selected from the group consisting of deodorants, antiperspirants, fragrances, pharmaceuticals, in any of the following pharmaceutical forms: creams, emulsions, pastes, gels, jelly, ointment and combinations thereof.

10. The applicator for pasty cosmetic products according to claim 1, wherein said film adhered to the substrate is selected from polyester, aluminized polyester, polypropylene, PVDC, polyamide and combinations thereof.

11. The applicator for pasty cosmetic products according to claim 1, wherein said removable laminar cover is selected from polyester laminates, aluminized polyester, heat-sealable polyester, aluminum, polypropylene, PVDC, polyamide, heat sealable lacquer and combinations thereof.

* * * * *